US008171681B2

(12) United States Patent
Miller

(10) Patent No.: US 8,171,681 B2
(45) Date of Patent: May 8, 2012

(54) INFLATABLE SHUTTER

(75) Inventor: James V. Miller, Glen Ellyn, IL (US)

(73) Assignee: Qualitas Manufacturing Incorporated, Ilasca, IL (US)

( * ) Notice: Subject to any disclaimer, the term of this patent is extended or adjusted under 35 U.S.C. 154(b) by 7 days.

(21) Appl. No.: 12/287,081

(22) Filed: Oct. 6, 2008

(65) Prior Publication Data

US 2010/0083585 A1 Apr. 8, 2010

(51) Int. Cl.
*E04G 11/04* (2006.01)

(52) U.S. Cl. ..... 52/202; 52/2.14; 52/2.11; 49/9

(58) Field of Classification Search ..... 52/2.11, 52/2.13, 2.14, 2.19, 2.24, 2.25, 2.26, 202, 52/473, 203; 102/303; 160/3; 49/9, 50, 49/57; 89/36.17, 36.04, 901, 920, 936, 939; 280/736

See application file for complete search history.

(56) References Cited

U.S. PATENT DOCUMENTS

| | | | | |
|---|---|---|---|---|
| 3,831,318 | A | 8/1974 | Richmond | |
| 4,023,372 | A * | 5/1977 | Presler et al. | 405/132 |
| 4,040,210 | A * | 8/1977 | Land | 52/2.12 |
| 4,255,907 | A | 3/1981 | Lightell | |
| 4,262,458 | A * | 4/1981 | O'Neal | 52/2.13 |
| 4,322,923 | A * | 4/1982 | O'Neal | 52/2.13 |
| 4,344,473 | A * | 8/1982 | Shore | 160/121.1 |
| 4,346,132 | A | 8/1982 | Cheng et al. | |
| 4,505,483 | A * | 3/1985 | Bent, Jr. | 277/646 |
| 4,544,587 | A * | 10/1985 | Nesbitt | 428/34 |
| 4,672,888 | A * | 6/1987 | Crombie et al. | 454/254 |
| 5,109,639 | A * | 5/1992 | Moore | 52/2.12 |
| 5,595,233 | A | 1/1997 | Gower | |
| 5,937,595 | A | 8/1999 | Miller | |
| 6,029,405 | A | 2/2000 | Wood | |
| 6,029,558 | A * | 2/2000 | Stevens et al. | 89/36.17 |
| 6,086,128 | A * | 7/2000 | Whitehead, Sr. | 296/24.41 |
| 6,266,926 | B1 | 7/2001 | Figge et al. | |
| 6,298,607 | B1 * | 10/2001 | Mostaghel et al. | 52/1 |
| 6,595,102 | B2 * | 7/2003 | Stevens et al. | 89/36.17 |
| 6,658,801 | B2 * | 12/2003 | Kilduff et al. | 52/202 |
| 6,709,008 | B2 * | 3/2004 | McGee et al. | 280/729 |
| 7,464,506 | B2 * | 12/2008 | Atkinson | 52/202 |
| 7,748,169 | B2 * | 7/2010 | Cote | 52/2.11 |
| 2002/0152881 | A1 * | 10/2002 | Stevens et al. | 89/36.17 |
| 2004/0253919 | A1 * | 12/2004 | Dube | 454/274 |
| 2006/0070305 | A1 | 4/2006 | Atkinson | |
| 2006/0086057 | A1 * | 4/2006 | Rasenberger et al. | 52/202 |
| 2006/0260210 | A1 * | 11/2006 | Tanielian et al. | 52/2.11 |
| 2006/0288646 | A1 * | 12/2006 | Pleasants | 49/465 |
| 2007/0113486 | A1 * | 5/2007 | Howland | 52/1 |
| 2007/0181271 | A1 * | 8/2007 | Earnest | 160/368.1 |
| 2008/0216416 | A1 * | 9/2008 | Leano | 52/2.22 |
| 2010/0281783 | A1 * | 11/2010 | Harrington | 52/2.23 |

FOREIGN PATENT DOCUMENTS

DE 3309085 A1 6/1984

* cited by examiner

*Primary Examiner* — Robert Canfield
*Assistant Examiner* — Babajide Demuren
(74) *Attorney, Agent, or Firm* — Ice Miller LLP

(57) ABSTRACT

An inflatable shutter is provided. The shutter comprises a protective layer and at least one air bladder, and is attached to the outside of a building structure. The shutter is positioned outside the building structure adjacent a window or other opening in order to protect the window or other opening from high velocity winds and flying debris during storms. The shutter may be removed from the outside of the building and compactly stored during periods of nonuse.

20 Claims, 4 Drawing Sheets

INFLATABLE SHUTTER

FIELD OF THE INVENTION

The present invention relates to shutters for use in buildings and, in particular, to inflatable shutters for protection of windows, doors and other exterior openings in a building.

Temporary shutters are commonly used to protect windows, doors, skylights, vents and other exterior openings in buildings from storm damage caused by high velocity winds and impacts from windborne debris. Conventional shutter systems include plywood panels and corrugated panels of steel, aluminum and plastic. The installation and removal of such conventional shutter systems is often labor intensive and may itself damage or mar the appearance of the building exterior. Plywood panels are typically nailed or screwed directly to the building structure. Installation of corrugated panels often involves the attachment of a rigid frame or other hardware to the building structure. In some cases, reinforcement bars may be required to hold the shutters in place.

Requirements for the protection of openings from hurricane damage are becoming more stringent. Different zones and ratings for temporary shutters have been designated by codes locally, nationally, and internationally. Each zone and rating has different standards and specification requirements. In Florida, for example, there are two zones, the HVHZ (High Velocity Hurricane Zone) and the NHVHZ (Non-High Velocity Hurricane Zone), each of these zones have distinct specifications under which the shutters must perform.

For example, in the NHVHZ, the shutter can deflect debris, even if it interferes with the window glazing (the glass or plastic portion of the window), so as long as the opening being protected is not compromised. Therefore, each shutter manufactured for use under a NHVHZ code district may be tested with, or without, any substructure and is found to pass the requirements as long as the shutter protects the opening completely by itself. That is, if the shutter protects the opening, with or without glass, the shutter passes the NHVHZ requirements.

In a HVHZ district, the shutter can not interfere with the window glazing. The HVHZ requirements were originally designated by Miami-Dade county in the 1990's after Hurricane Andrew caused severe structural damage and local building authorities were held, at least in part, accountable for the failure of the protective shutters. Dade county continues to maintain these requirements, even though from an engineering stand-point they make little sense.

In a HVHZ district, the most difficult test to meet is that the protective shutter cannot deflect debris into the opening that could cause damage to the window glazing. It is a well understood phenomena that deflection increases during a storm as pressure increases and the size of the opening sought to be protected increases.

Strong, lightweight products have been engineered, tested, and approved for areas covered by the NHVHZ regulations. Unfortunately, these same products fail to qualify in areas governed by HVHZ regulations because of how they deflect debris. To overcome this problem, shutters have been manufactured with a rigid framing. However, rigid framed shutters significantly increase the overall system's prices, as well as creating additional engineering problems.

Conventional shutters are heavy and cumbersome due to the size and weight of the materials utilized in their manufacture. Conventional shutters may weigh 50 lbs or more, making them difficult to handle during installation and removal, particularly when only one person is available for installation or removal. Furthermore, conventional shutters are bulky and require significant storage space when not in use. Thus, there is a need for an inflatable shutter that is simple to install and remove, is lightweight, and requires minimal storage space when not in use.

SUMMARY OF THE INVENTION

These needs and other needs are satisfied by the present invention, which comprises an inflatable shutter for covering an opening in a building structure. The inflatable shutter comprises a protective layer sized and shaped to cover the opening and at least one air bladder positioned between the protective layer and the building structure providing a protective cavity between the protective layer and the opening.

In an alternative embodiment, the inflatable shutter comprises a protective layer sized and shaped to cover the opening, at least one air bladder positioned between the protective layer and the building structure providing a protective cavity between the protective layer and the opening, and a fastener connected to the air bladder for mounting the shutter over the opening on the building structure.

In yet another alternative embodiment, the inflatable shutter comprises a protective layer sized and shaped to cover the opening, at least one air bladder positioned between the protective layer and the building structure providing a protective cavity between the protective layer and the opening, and a fastener connected to the protective layer for mounting the shutter over the opening on the building structure.

In yet another alternative embodiment, the inflatable shutter comprises two air bladders positioned along either the longitudinal edges or the horizontal edges of the building structure adjacent to the opening in the structure.

In yet another alternative embodiment, the inflatable shutter comprises a plurality of air bladders positioned along both the longitudinal and the horizontal edges of the building structure adjacent to the opening in the structure.

BRIEF DESCRIPTION OF THE DRAWINGS

Embodiments of the invention will now be explained in further detail by way of example only with reference to the accompanying figures, in which.

DETAILED DESCRIPTION OF THE INVENTION

Figure 1:
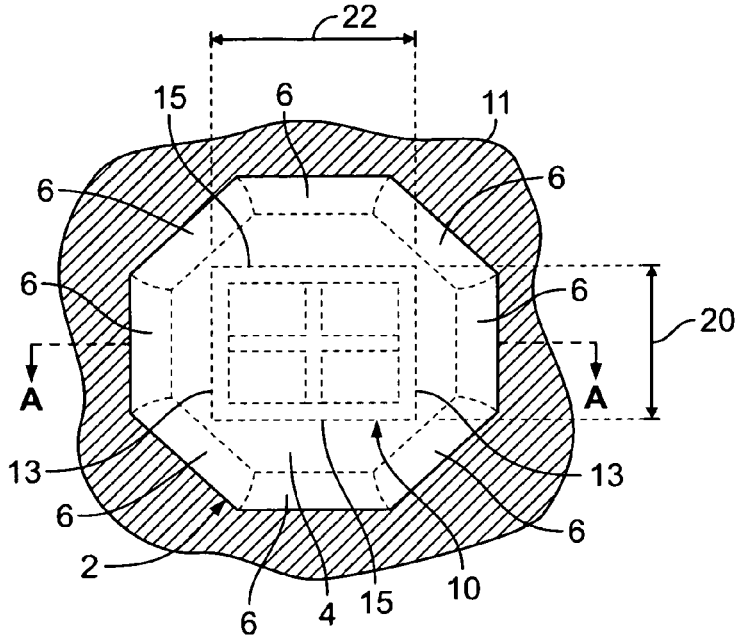
FIG. 1 is front section view of an inflatable shutter installed over an exterior window of a building.

Referring to FIGS. 1-4, an inflatable shutter is shown installed by a fastener over the opening of a building structure. In the embodiment shown in FIG. 1, the inflatable shutter 2 is secured over a window 10 of a building structure 11. Inflatable shutter 2 comprises a protective layer 4, stretched over a plurality of air bladders 6. Air bladders 6 abut building structure 11 on the longitudinal 13 and/or horizontal 15 edges of the structure, thereby providing a protective cavity 16 (shown in FIG. 2) between protective layer 4 and window 10.

Referring to FIG. 1, protective layer 4 of inflatable shutter 2 directly receives strong winds and windborne debris. Therefore, it must be dimensioned such that it covers the perimeter of window 10, defined by a height 20 and length 22. As a result, no part of window 10 is exposed. Although inflatable shutter 2 covers a window 10, those of ordinary skill in the art will understand that such a shutter may also be useful over other openings, such as doorways and vents.

Protective layer 4 can be made of any suitable sheeting, woven or nonwoven fabric, composite, or other material known in the art capable of withstanding strong winds and windborne debris. Examples of such materials include Kevlar® and Nylon. Materials used in the construction of commercially available trampolines may also be utilized in the present invention (See, for example, denier polyester and PVC vinyl). The material should be provided with a weight and thickness sufficient to withstand high winds and windborne debris without breaking. Preferably, the material used to make protective layer 4 is translucent to allow light through window 10 when inflatable shutter 2 is in use.

The size and shapes of protective layer 4 can vary. FIG. 1 shows a protective layer 4 of a hexagonal shape. However, different shapes and sizes may be used. Depending on the size and shape of the opening being covered by inflatable shutter 2, it may be advantageous to deviate from the embodiment shown, such as by the use of a square or round protective layer.

Figure 2:
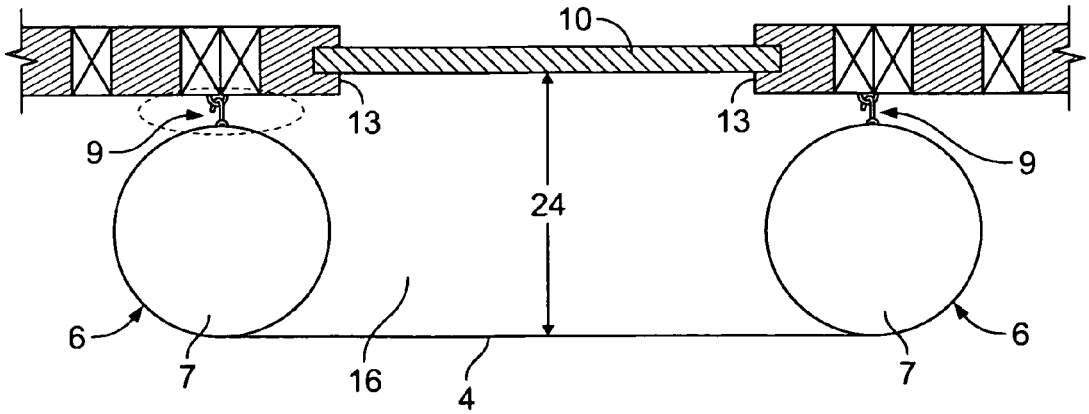
FIG. 2 is a horizontal section view of the inflatable shutter of FIG. 1, taken across lines A-A.

Referring to FIG. 2, inflatable shutter 2 includes air bladders 6 which have inflatable air chambers 7. Dependent on the size of the opening to be protected, inflatable shutter 2 comprises either a pair of air bladders 6 located on the longitudinal 13 or horizontal 15 edges of the structure 11 or multiple pairs of air bladders 6 located on both the longitudinal 13 and horizontal 15 edges of the structure. Air bladders 6 lie between protective layer 4 and building structure 11, thereby providing a protective cavity 16 forming a distance 24 between protective layer 4 and window 10. The size of protective cavity 16 is established based on the deflective and impact properties of the shutter 2. Therefore, when air bladders 6 are inflated to form protective cavity 16, inflatable shutter 2 does not deflect into the window glazing while the shutter protects window 10 from flying debris. Additionally, air bladders 6 absorb the impact of windborne debris during a storm and reduce the pressure applied to fasteners 9, described below.

Air bladders 6 may be formed of any suitable flexible sheeting, woven or nonwoven fabric, composite, or other material known in the art capable of forming an airtight chamber. Rubber modified polypropylene is one example of such a material. Although protective layer 4 directly receives the winds and windborne debris, air bladders 6 should also be able to withstand high velocity winds and windborne debris without failing.

Figure 5:
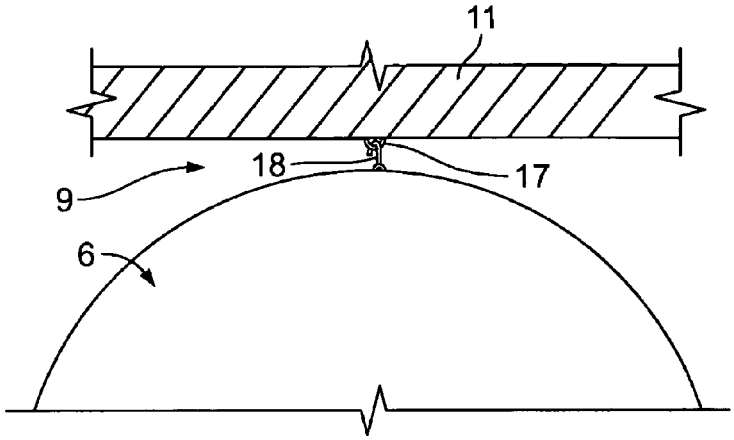
FIG. 5 is a detailed view of a fastener of the inflatable shutter of FIGS. 1-4.

Inflatable shutter 2 is installed on a building structure 11 by fasteners 9. Referring to FIG. 5, an embodiment is shown in which fasteners 9 comprise a receiving member 17 and an attachment member 18. Receiving member 17 is mounted on building structure 11 and cooperates with attachment member 18 to secure inflatable shutter 2 to the building. In this embodiment, receiving member 17 is a ring, and attachment member 18 is a hook. In some situations, receiving member 17 may be unnecessary. One may prefer to simply attach attachment member 18 to an appendage of structure 11 rather than to a receiving member 17, if such an appendage is available. Alternatively, instead of a ring and hook, one may desire to install bolts, clamps, latches, locks, buckles or any other suitable connection method known in the art to the building structure and/or the ends of the tethers so that the shutter may be quickly installed before a storm.

Figure 6:
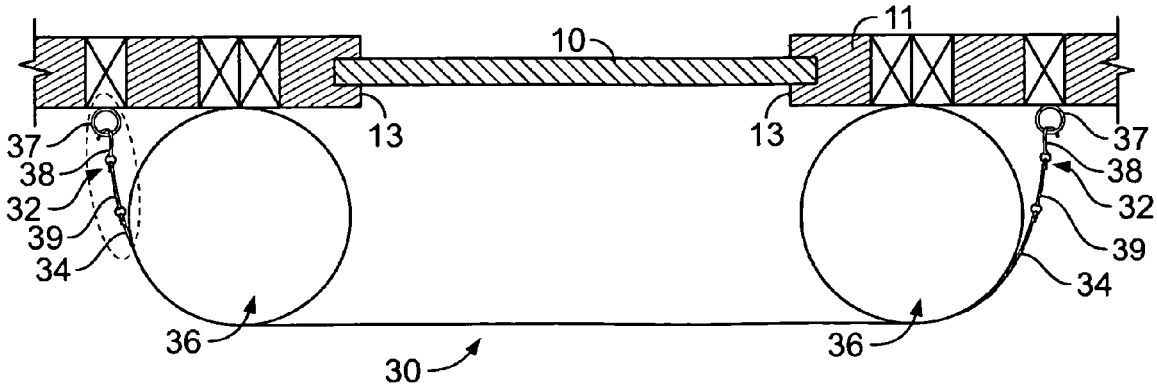
FIG. 6 is a horizontal section view of an alternative inflatable shutter installed over an exterior window of a building.
Figure 7:
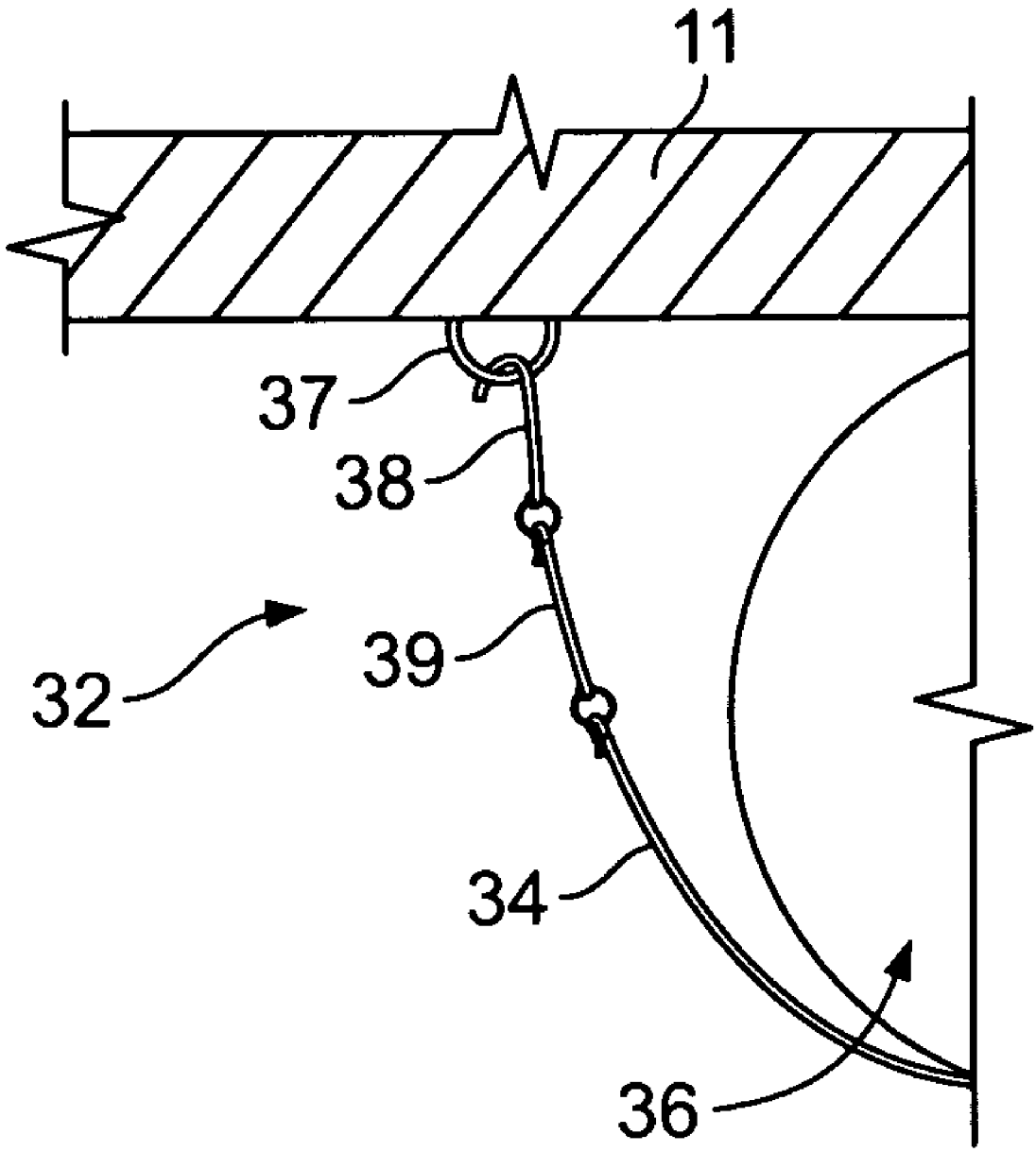
FIG. 7 is a detailed view of a fastener of the inflatable shutter of FIG. 6.

Referring to FIGS. 6-7, an alternative embodiment of an inflatable shutter 30 is shown in which each fastener 32 comprises a tether 34, a receiving member 37, an attachment member 38 and preferably a pressure relief section 39. The main difference between this embodiment and the embodiment of FIG. 5 is that, in this embodiment, tether 34 and pressure relief section 39 connect attachment member 38 to the rest of shutter 30, rather than attachment member 38 being directly attached. The addition of tether 34 and pressure relief section 39 provide added support to shutter 30 to allow it to withstand increased amounts of wind pressure. Like the embodiment of FIG. 5, receiving member 37 is mounted on building structure 11 and cooperates with attachment member 38 to secure inflatable shutter 30 to the building.

Tethers 34 can be made of any suitable material strong enough to hold the shutter in place during periods of high velocity winds. In one embodiment, tethers 34 are cords made out of polypropylene fibers. Tethers 34 should be flexible, but at the same time should be stiff enough that shutter 30 resists separation from building structure 11 as it receives high velocity winds and windborne debris during a storm.

Pressure relief section 39 links tether 34 to attachment member 38. In one embodiment, pressure relief section 39 is an elastic cord composed of one or more elastic strands forming a core, which are covered in a woven sheath of nylon or cotton. The elasticity of pressure relief section 39 allows it to absorb negative pressure during inflation of air bladders 36 without transferring direct pressure to attachment member 38. As inflatable shutter 30 is installed, positive pressure will build up between the shutter and the building structure 11. Pressure relief section 39 releases this pressure, as do the air bladders 36.

Figure 3:
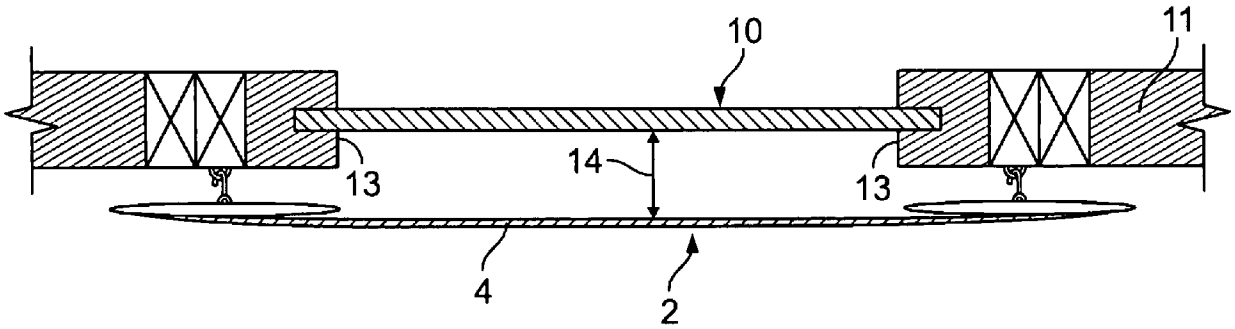
FIG. 3 is a horizontal section view of the inflatable shutter of FIG. 1, showing unexpanded air bladders.
Figure 4:
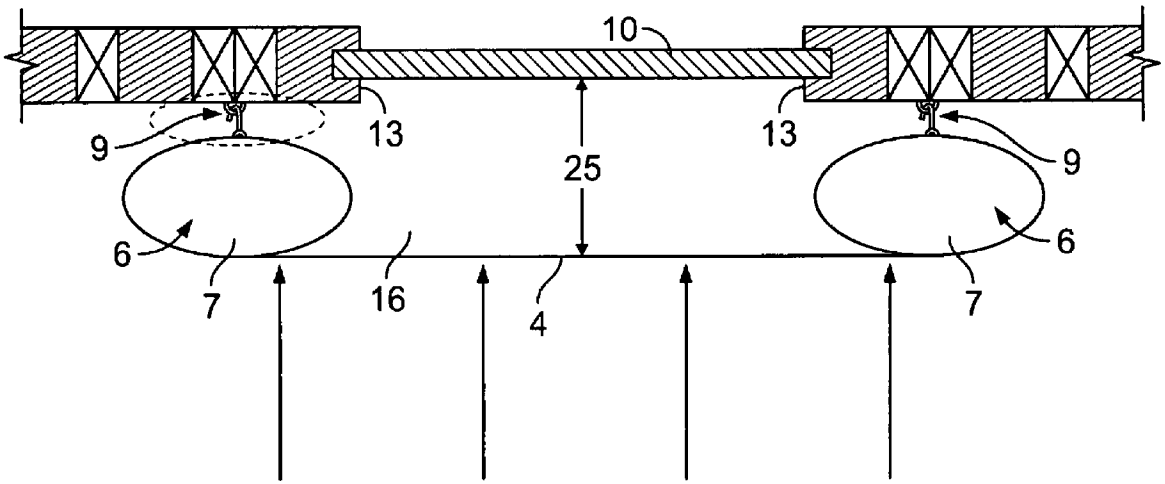
FIG. 4 is a horizontal section view of the inflatable shutter of FIG. 1, showing the inflatable shutter receiving wind pressure.

Referring back to FIGS. 2-4, inflatable shutter 2 is preferably attached to building structure 11 by first attaching attachment member 18 to receiving member 17, and then inflating the air bladders 6. FIG. 3 shows inflatable shutter 2 after attachment to building structure 11, but before inflation of the air bladders 6. At this stage in the installation, there is a distance 14 between inflatable shutter 2 and window 10. Air bladders 6 are then inflated until protective cavity 16 of distance 24 is formed between shutter 2 and window 10, as shown in FIG. 2. Referring to FIG. 4, as inflatable shutter 2 absorbs pressure from wind and windborne debris, air bladders 6 form an oblong shape and protective cavity 16 decreases to a distance 25 between shutter 2 and window 10. By absorbing the wind pressure, air bladders 6 reduce the pressure applied to fasteners 9.

Inflatable shutter 2 is preferably removed from a building structure after use by deflating air bladders 6 before fasteners 9 are unfastened. This removal method allows the tension in fasteners 9 to decrease before they are unfastened, thereby simplifying removal of inflatable shutter 2.

Since shutter 2 is inflatable and does not contain a rigid frame, installation and subsequent storage of the shutter is relatively simple. When not in use, shutter 2 can be deflated and folded or rolled-up for compact storage. Then, when a storm approaches, shutter 2 can simply be unfolded or unrolled and installed.

Modifications in addition to those described above may be made to the structures and techniques described herein without departing from the spirit and scope of the invention.

Accordingly, although specific embodiments have been described, these are examples only and are not limiting on the scope of the invention.

What is claimed is:

1. A shutter attached to and detachable from an exterior face of a building for protecting a covered opening on the building, the shutter comprising:

a non-inflatable protective layer positioned over the covered opening, said protective layer comprising a wind-resistant material sized and shaped to protect the covered opening; and at least one inflated air bladder positioned on the exterior face of the building outside a perimeter of the covered opening and between the protective layer and the exterior face of the building so that the air bladder and protective layer provide a protective cavity between the protective layer and the covered opening, wherein the protective cavity is sized according to deflective and impact resistance properties of the protective layer and the inflated air bladder in such a manner that the shutter resists an impact from wind or windborne debris to prevent the protective layer from deflecting and contacting the covered opening under such impact.

2. The shutter of claim 1, wherein the at least one air bladder comprises two air bladders positioned along longitudinal edges of the covered opening.

3. The shutter of claim 1, wherein the at least one air bladder comprises two air bladders positioned along horizontal edges of the covered opening.

4. The shutter of claim 1, wherein the at least one air bladder comprises a plurality of air bladders positioned along both longitudinal and horizontal edges of the covered opening.

5. A shutter attached to and detachable from an exterior face of a building for protecting a covered opening on the building, the shutter comprising:

a non-inflatable protective layer positioned over the covered opening, said protective layer comprising wind-resistant material sized and shaped to protect the covered opening;

at least one inflated air bladder positioned on the exterior face of the building outside a perimeter of the covered opening and between the protective layer and the exterior face of the building so that the air bladder and protective layer provide a protective cavity between the protective layer and the covered opening; and a fastener connected to the air bladder for mounting the shutter over the covered opening on the exterior face of the building, wherein the protective cavity is sized according to deflective and impact resistance properties of the protective layer and the inflated air bladder in such a manner that the shutter resists an impact from wind or windborne debris to prevent the protective layer from deflecting and contacting the covered opening under such impact.

6. The shutter of claim 5, wherein the at least one air bladder comprises two air bladders positioned along longitudinal edges of the covered opening.

7. The shutter of claim 5, wherein the at least one air bladder comprises two air bladders positioned along horizontal edges of the covered opening.

8. The shutter of claim 5, wherein the at least one air bladder comprises a plurality of air bladders positioned along both the longitudinal and horizontal edges of the covered opening.

9. The shutter of claim 5, wherein the fastener comprises an attachment member.

10. The shutter of claim 9, wherein the fastener further comprises a receiving member mounted on the exterior face of the building and releasably attached to the attachment member.

11. The shutter of claim 10, wherein the fastener further comprises a tether.

12. The shutter of claim 11, wherein the fastener further comprises a pressure relief section.

13. A shutter attached to and detachable from the exterior face of a building for protecting a covered opening on the exterior face of a building, the shutter comprising:

a non-inflatable protective layer positioned over the covered opening, said protective layer comprising wind-resistant material sized and shaped to protect the covered opening;

at least one inflated air bladder positioned on the exterior face of the building outside a perimeter of the covered opening and between the protective layer and the exterior face of the building so that the air bladder and protective layer provide a protective cavity between the protective layer and the covered opening; and a fastener connected to the protective layer capable of mounting the shutter over the covered opening on the building, wherein the protective cavity is sized according to deflective and impact resistance properties of the protective layer and the inflated air bladder in such a manner that the shutter resists an impact from wind or windborne debris to prevent the protective layer from deflecting and contacting the covered opening under such impact.

14. The shutter of claim 13, wherein the at least one air bladder comprises two air bladders positioned along longitudinal edges of the covered opening.

15. The shutter of claim 13, wherein the at least one air bladder comprises two air bladders positioned along horizontal edges of the covered opening.

16. The shutter of claim 13, wherein the at least one air bladder comprises a plurality of air bladders positioned along both longitudinal and horizontal edges of the covered opening.

17. The shutter of claim 13, wherein the fastener comprises an attachment member.

18. The shutter of claim 17, wherein the fastener further comprises a receiving member mounted on the exterior face of the building and releasably attached to the attachment member.

19. The shutter of claim 17, wherein the fastener further comprises a tether.

20. The shutter of claim 19, wherein the fastener further comprises a pressure relief section.

* * * * *